US010167179B2

(12) United States Patent
Gribnitz et al.

(10) Patent No.: US 10,167,179 B2
(45) Date of Patent: Jan. 1, 2019

(54) JACK SYSTEM

(71) Applicants: Kurt Georg Gribnitz, Secunda (ZA); Jan Hendrik Van Der Merwe, Bethal (ZA)

(72) Inventors: Kurt Georg Gribnitz, Secunda (ZA); Jan Hendrik Van Der Merwe, Bethal (ZA)

(73) Assignee: KURTJAN JACKS (PTY) LTD., Trichardt (ZA)

( * ) Notice: Subject to any disclaimer, the term of this patent is extended or adjusted under 35 U.S.C. 154(b) by 86 days.

(21) Appl. No.: 15/242,718

(22) Filed: Aug. 22, 2016

(65) Prior Publication Data

US 2017/0113906 A1 Apr. 27, 2017

(51) Int. Cl.

| | |
|---|---|
| ***B66F 3/00*** | (2006.01) |
| ***B66F 3/25*** | (2006.01) |
| ***B66F 7/06*** | (2006.01) |
| ***B66F 7/08*** | (2006.01) |
| ***B66F 7/28*** | (2006.01) |
| ***B66F 3/10*** | (2006.01) |

(52) U.S. Cl.

CPC ..... *B66F 3/25* (2013.01); *B66F 3/10* (2013.01); *B66F 7/0633* (2013.01); *B66F 7/08* (2013.01); *B66F 7/28* (2013.01)

(58) Field of Classification Search

CPC ..... A61G 19/00; A63B 3/00; B66F 2700/12; B66F 2700/123; B66F 2700/126; B66F 3/10; B66F 7/0608; B66F 7/0633; B66F 7/0641; B66F 7/0691; B66F 7/08; B66F 7/14; B66F 7/16; B66F 7/20; B66F 7/28; F16L 1/0246; F16L 3/00; F16L 3/01

See application file for complete search history.

(56) References Cited

U.S. PATENT DOCUMENTS

| | | | | | |
|---|---|---|---|---|---|
| 122,481 | A * | 1/1872 | Morton | B66F 7/0641 | 254/89 R |
| 336,161 | A * | 2/1886 | Robburts | B66F 7/0641 | 254/89 R |
| 409,008 | A * | 8/1889 | Breymann | B25B 27/10 | 29/237 |
| 889,315 | A * | 6/1908 | Kenyon | B25B 27/023 | 254/29 R |
| 1,201,718 | A * | 10/1916 | Gibson | B66F 7/0641 | 254/89 R |
| 1,281,491 | A * | 10/1918 | Black | B66F 7/0641 | 254/89 R |

(Continued)

FOREIGN PATENT DOCUMENTS

| | | | | |
|---|---|---|---|---|
| CH | 102173 A * | 11/1923 | | B60P 1/34 |
| EP | 0403404 A2 * | 12/1990 | | B66F 7/0633 |

(Continued)

*Primary Examiner* — Tyrone V Hall, Jr.

(74) *Attorney, Agent, or Firm* — Law Offices of Steven W. Weinrieb

(57) ABSTRACT

The present invention relates to inspection and repair of piping, pipe supports and other often elevated cable racks on chemical, metallurgical and other industrial plants. In particular, the invention relates to devices and systems for lifting or raising heavy objects relatively short heights. More specifically, the invention relates to a jack system and a jack used with said system.

11 Claims, 4 Drawing Sheets

(56) References Cited

U.S. PATENT DOCUMENTS

| | | | | | |
|---|---|---|---|---|---|
| 1,991,255 | A * | 2/1935 | Martin | B66F 7/0608 | 187/211 |
| 2,023,410 | A * | 12/1935 | Davis | B66F 7/0608 | 254/126 |
| 2,617,678 | A * | 11/1952 | Kelso | B66C 1/422 | 294/113 |
| 2,896,909 | A * | 7/1959 | Taylor | B60P 1/025 | 254/134 |
| 2,929,519 | A * | 3/1960 | Taylor | B60P 1/02 | 414/590 |
| 3,019,858 | A * | 2/1962 | Olson | B66F 7/18 | 187/219 |
| 3,451,711 | A * | 6/1969 | Carpenter | B66C 1/422 | 294/106 |
| 3,976,281 | A * | 8/1976 | Adamson, Jr. | B66F 7/0608 | 254/126 |
| 4,218,044 | A * | 8/1980 | Ikhsanov | F16L 55/18 | 254/93 R |
| 4,750,712 | A * | 6/1988 | Genovese | B66F 7/0633 | 254/122 |
| 5,012,879 | A * | 5/1991 | Bienek | B66F 3/12 | 180/313 |
| 8,596,612 | B1 * | 12/2013 | Green | F16L 3/20 | 254/10 B |

FOREIGN PATENT DOCUMENTS

| | | | | |
|---|---|---|---|---|
| EP | 1142825 | A1 * | 10/2001 | B66F 7/0608 |
| FR | 2578524 | A1 * | 9/1986 | B66F 7/0608 |
| GB | 2206859 | A * | 1/1989 | B66F 7/0608 |
| WO | WO8604570 | A * | 8/1986 | |

* cited by examiner

JACK SYSTEM

FIELD OF THE INVENTION

This invention relates to inspection and repair of elevated piping, cable racks and the like on industrial sites such as, for example, refineries, petrochemical and metallurgical plants. In essence, the invention focuses on lifting or raising of heavy objects for relatively short distances. More specifically, the invention relates to a jack system and a jack used with said system.

BACKGROUND TO THE INVENTION

A variety of devices are known and used nowadays to selectively lift and lower heavy objects, relative to a specific position. However, where the heavy objects are plant cable racks, elevated piping, not all lifting and lowering devices are equally suitable.

Where elevated piping, cable racks, or supports therefore, require corrosion protection, painting, welding, cable placement and other maintenance or inspection activities, cranes with riggers and operators, chainfalls and so-called "bobby jacks" are often utilized to assist with lifting and lowering operations. While all of the abovementioned devices are capable of achieving selective lifting or lowering of the heavy elevated piping, cable racks, or supports therefore; not all are equally effective, safe and user friendly.

It is believed that the jack, system of this invention and the jack used with said system address shortcomings in the abovementioned prior art systems and provide a safe solution to a long-felt need in industry.

SUMMARY OF THE INVENTION

In accordance with this invention there is provided a jack system for selectively raising and lowering one or more elevated pipes or cable racks to and from a set position relative to a fixed support structure, the jack system comprising:

- at least two elongate holding members, configured to operatively support from beneath and hold the one or more elevated pipes or cable racks in either a raised, or lowered, position above the fixed support structure thereby to permit access to a contact area defined between the fixed support structure and the one or more elevated pipes or cable racks;
- at least two opposing and spaced apart jacks adapted to function in identical fashion to assist in raising and lowering of the at least two elongate holding members relative to the fixed support structure, each jack comprising:
  - seating means, adapted to seat the at least two elongate holding members;
  - at least two arms, located laterally outward relative to the fixed support structure, each arm including first and second extremities, the first extremity being operable to be brought into contact with the fixed support structure thereby to prop each jack against the fixed support structure, the second extremity being disposed at an angle relative to the first extremity and displaceable laterally towards and away from the fixed support structure; and
  - a main movable body, connected to each of the at least two arms and configured to move the respective second extremities of the arms selectively laterally towards and away from the fixed support structure thereby to selectively raise and lower the respective seating means and consequently the at least two elongate holding members.

In an embodiment of the invention, the jack system comprises three or more spaced apart jacks laterally facing each other, with pipes or cable racks to be selectively raised and lowered, spaced therebetween.

There is also provided for the main movable body to comprise: chain links that extend linearly between the respective opposing second extremities of each arm; and a manually rotatable lever connected via a ratchet mechanism to said chain links, the lever being operable to permit an operator to manually either tauten or release tension between said chain links.

There is further provided for the jack system to comprise rigid limbs that flank the ratchet mechanism, ends of each limb comprising a hook to permit selective positioning of said hook through any of said number of chain links thereby to selectively raise or lower the elongate holding members depending on which chain link the hook extends through.

Moreover, the invention provides for the main movable body of the jack system to alternatively include a pneumatically actuated piston displaceably located within a cylinder such that said piston is operatively permitted to move rectilinearly within said cylinder upon electronic actuation thereof thereby to displace said opposing second extremities selectively towards and away from each other.

The jack system may alternatively comprise a telescopic sleeve having an internal screw thread within which a manually or electronically actuated rectilinearly moveable screw threaded piston is displaceably located thereby to electronically or manually displace said opposing second extremities selectively towards and away from each other.

In an embodiment, the jack system includes an elongate rod extending linearly below the main movable body, the rod having a threaded outer surface, to which lock-out nuts are provided so that opposing ends of the rod can be locked out relative to the respective arms upon reach of a desired elongate holding member elevation.

In addition, the invention provides for each of the first extremities to comprise a protuberant formation configured to bear against and prop the respective arms against an outer surface of the fixed support structure.

The second extremities may each comprise an aperture through which a securing pin can extend to operatively hold the main movable body in position between the extremities of said opposing arms.

In an embodiment, the seating means comprises a peripheral edge of a semi-circular cut-out portion formed in a central region of each of the respective arms.

In an embodiment, the seating means comprises a concave appendage attached to, or formed in, a central region of each of the respective arms.

The central region of each arm where said semi-circular cut-out portion or appendage is defined may be bent at an angle of between about 100° and 130° thereby to permit upward movement of the respective elongate holding members when the main movable body is actuated.

The invention furthermore extends to a jack comprising:

- seating means, adapted to seat at least two elongate holding members employed to operatively support from beneath and hold one or more elevated pipes or cable racks in either a raised, or lowered, position above a fixed support structure thereby to permit access to a contact area defined between said fixed support structure and said one or more elevated pipes or cable racks;

at least two arms, in use, located laterally outward relative to said fixed support structure, each arm including first and second extremities, the first extremity being operable to be brought into contact with said fixed support structure thereby to prop each jack against said fixed support structure, said second extremity being disposed at an angle relative to said first extremity and displaceable laterally towards and away from said fixed support structure; and a main movable body, connected to each of said at least two arms and configured to move said respective second extremities of said arms selectively laterally towards and away from said fixed support structure thereby to selectively raise and lower said respective seating means and consequently said at least two elongate holding members.

BRIEF DESCRIPTION OF THE DRAWINGS

Embodiments of the invention are now described, by way of example, with reference to the accompanying non-limiting diagrammatic drawings. In the drawings.

DETAILED DESCRIPTION OF THE DRAWINGS

Figure 1:
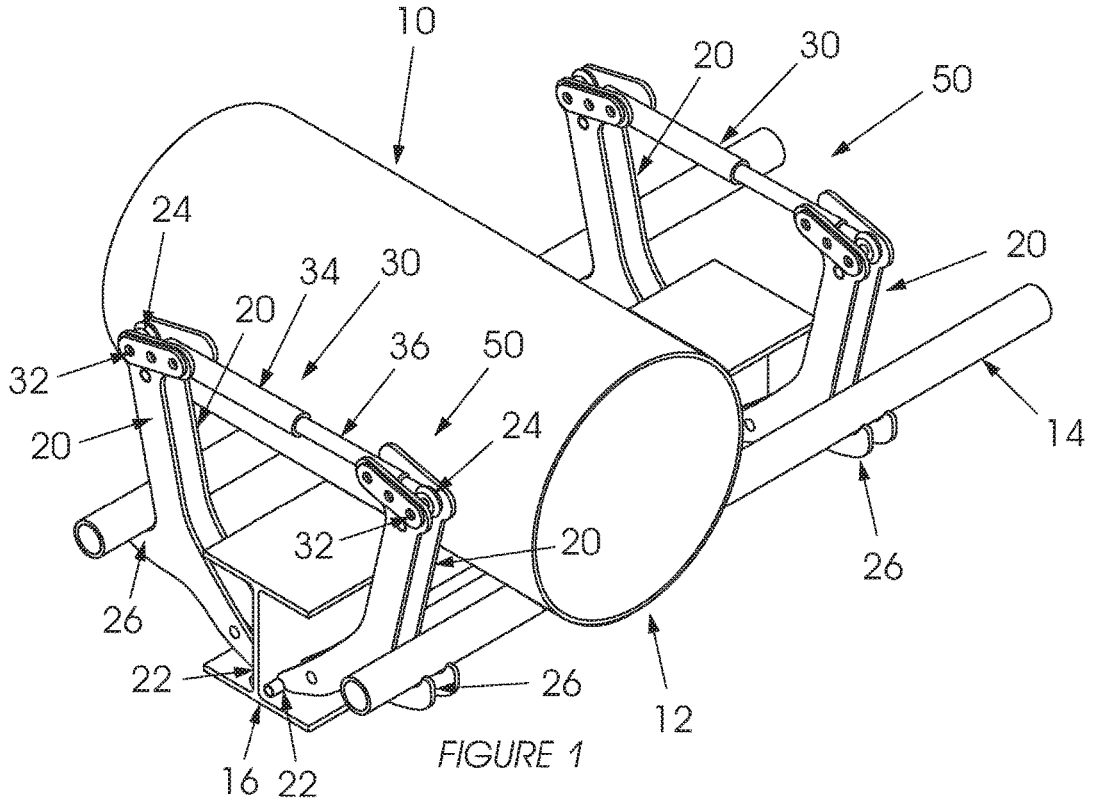
FIG. 1 shows an isometric view of a jack system according to an embodiment of the invention, with the jack thereof being shown in its lowered configuration.

This description is presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how at least some of the several forms of the invention may be embodied in practice.

Referring to FIGS. 1 to 4, reference numeral 10 generally indicates a jack system in accordance with the invention. Referring to FIGS. 5 to 8, reference numeral 100 generally indicates a jack system in accordance with a further embodiments of the invention.

Important to note is that, although this specification makes mention of use of jacks 50,150 and the jack system 10,100 only with reference to lifting and lowering of pipes 12,112, it is envisaged that the jacks 50,150 and jack system 10,100 are equally suitable for use in lifting elevated cable racks and the like. It will, however, be appreciated that the pipes 12,112 may even be in live operation, i.e. contain a flowable substance during the lifting or lowering process by means of the pipe jacks 50,150. For the sake of clarity however, the specification further only describes use of the jacks 50,150 and jack system 10,100 in the context of pipes 12,112.

Figure 3:
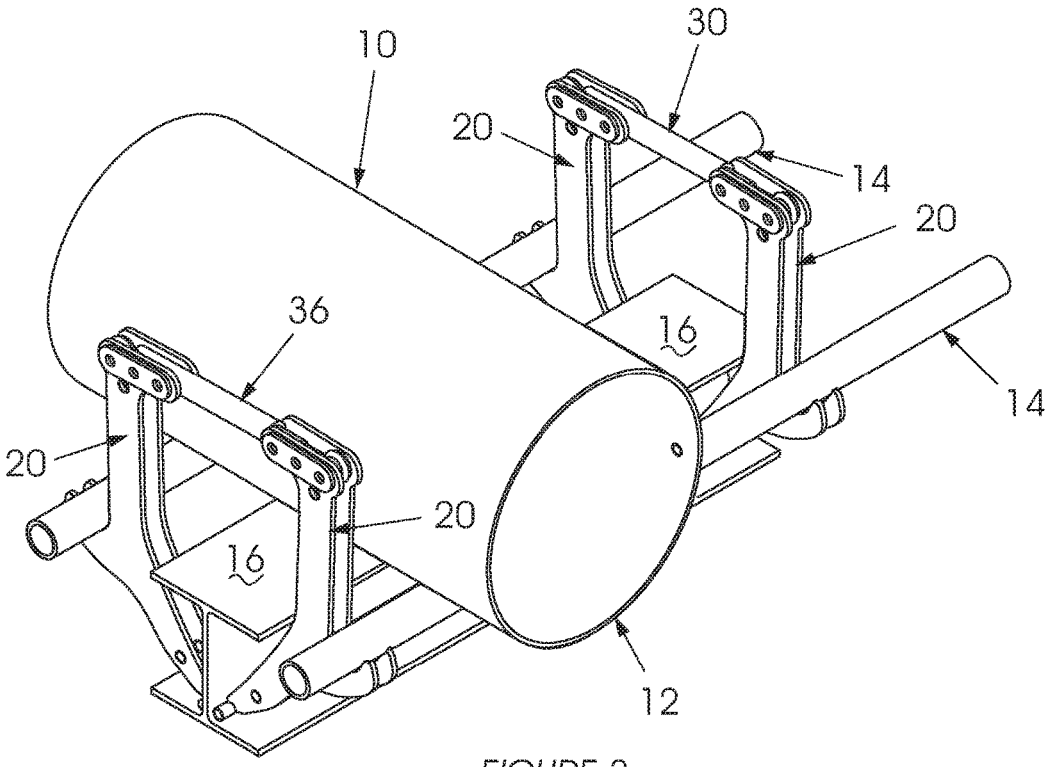
FIG. 3 shows an isometric view of the pipe jack system of FIG. 1, with the pipe jack thereof being shown in its raised configuration.

Referring to jack system 10, it includes two opposing and spaced apart jacks 50 which function in identical fashion to assist in raising, as shown in FIG. 3, and lowering, as shown in FIG. 1, a pipe 12 or even a rack of pipes (not shown) lying alongside each other. In the latter case, the pipe jacks 50 are spaced laterally between the multiple pipes so that a number of pipes on a pipe rack can all be attended to all at once when maintenance and inspection activities need to be performed. This is believed to save valuable man hours and increase productivity.

The system 10, besides consisting of the jacks 50, further includes two elongate pipe holding members 14 configured to operatively hold one or more pipes 12 to be worked on or inspected in a desired position raised relative to a fixed support structure, typically, an I-beam 16. Although, this specification only makes reference to an I-beam as the fixed construction, it will be appreciated that in other embodiments, the fixed support structure may be a concrete formation, plinth or the like. As depicted in the Figures, the two elongate pipe holding members 14 are circular cylindrical tubes. In other non-shown embodiments of the invention the two elongate pipe holding members 14 may typically, be selected from bars, pipes or rods, alternatively, square tubing. In essence, any elongate structural member capable of supporting heavy filled pipelines may be utilized as pipe holding members.

Each pipe jack 50 is further configured to be mounted in place on respective lateral sides of the pipe 12 on the fixed support structure 16, as shown in FIGS. 1 to 4.

Each jack 50 further consists of two elongate arms 20, each arm 20 being disposed between first and second extremities 22 and 24.

The first extremity 22 has a short rod-like protuberance which is operatively brought into contact with the fixed support structure or I-beam 16 thereby to brace or prop the jack 50 against the I-beam 16 before the pipe 12 is raised. At this stage, the second extremity 24 is disposed at an acute angle relative to the first extremity 22. The second extremity 24 is, however, displaceable towards and away from the I-beam 16 by way of a movable main movable body 30.

Each pipe jack 50 further consists of a seating means 26, provided on the two arms 20. It will be appreciated that in certain cases shims, shoes, brackets, and/or sliding plates may be provided to distribute "point loading" between the seating means 26 and the pipe. The seating means 26 is adapted to seat the two opposing elongate pipe holding members or circular cylindrical tubing 14 such that same can be positioned below the pipe 12. It is envisaged that the tubing 14 may even be provided with a cushioning layer, typically manufactured from a yieldable relatively soft material such as rubber, adapted to prevent damage which may occur as a result of impact or contact between the tubing 14 and a lower outer surface of the pipe 12. As shown in FIGS. 1 to 4, the seating means 26 is in the form of a semi-circular cut-out portion formed in a central region of each of the respective arms 20. At these central regions, the respective arms define a bend having a beam facing angle of between 100 degrees and 130 degrees. The angle assists in effective upward and downward movement of the seating means 26.

It is however envisaged that in other embodiments, a concave appendage may even be attached to each of the respective arms 20 to act as seating means. In another non-shown embodiment, the seating means may even comprise a peripheral edge of a circular cut-out portion in a central region of each linkage 20 so as to permit positioning of the tubing 14 in contact with, and supported by, this edge.

The main movable body 30 is connected via a suitable pin (not shown) via aperture 32 to each of the extremities 24 of the two arms 20. The main movable body 30 is adapted to move the respective second extremities 24 selectively towards and away from the fixed support structure or I-beam 16 in a general direction parallel to the axis A-A indicated in FIG. 1, thereby to selectively raise and lower the vertical position of the seating means 26. In so doing, the elongate holding members or tubing 14 on which the pipe 12 is operatively positioned is selectively raised and lowered.

It will be appreciated that the main movable body 30 includes a manual, electronic or hydraulically operated cylinder 34 having an internally located piston 36, which is displaceably located within the cylinder 34. The piston 36, in use, moves inward and outward relative to the cylinder 34 and thereby ensures selective widening and retraction of the distance between two opposing extremities 24 of each pipe jack 50. The retraction effects raising of the pipe 12 as shown in FIG. 3, whereas extension or widening of the gap between opposing extremities 24 effects lowering of the pipe 12.

A further embodiment of the invention is shown in FIGS. 5 to 8, where like reference numerals refers to like components, when compared to the embodiment shown in FIGS. 1 to 4.

It will be appreciated that this embodiment of the invention extends to combined use of manual operation of the movable main movable body 130 and electronic/pneumatic use of a movable secondary body 170.

Although the main movable body 130 and secondary movable body 170 are shown and described, movement made possible by use of devices selected from the group consisting of hydraulic ram mechanisms; rack-and-pinion mechanisms; ratchet-and-pawl mechanisms; pistons actuated through bevel-wheel gearings, worm gearings, through multiple or change-speed or hydraulic gearings; fluid-pressure operated systems; fluid-pressure servomotor systems; gearings and the like may alternatively be utilized.

Figure 5:
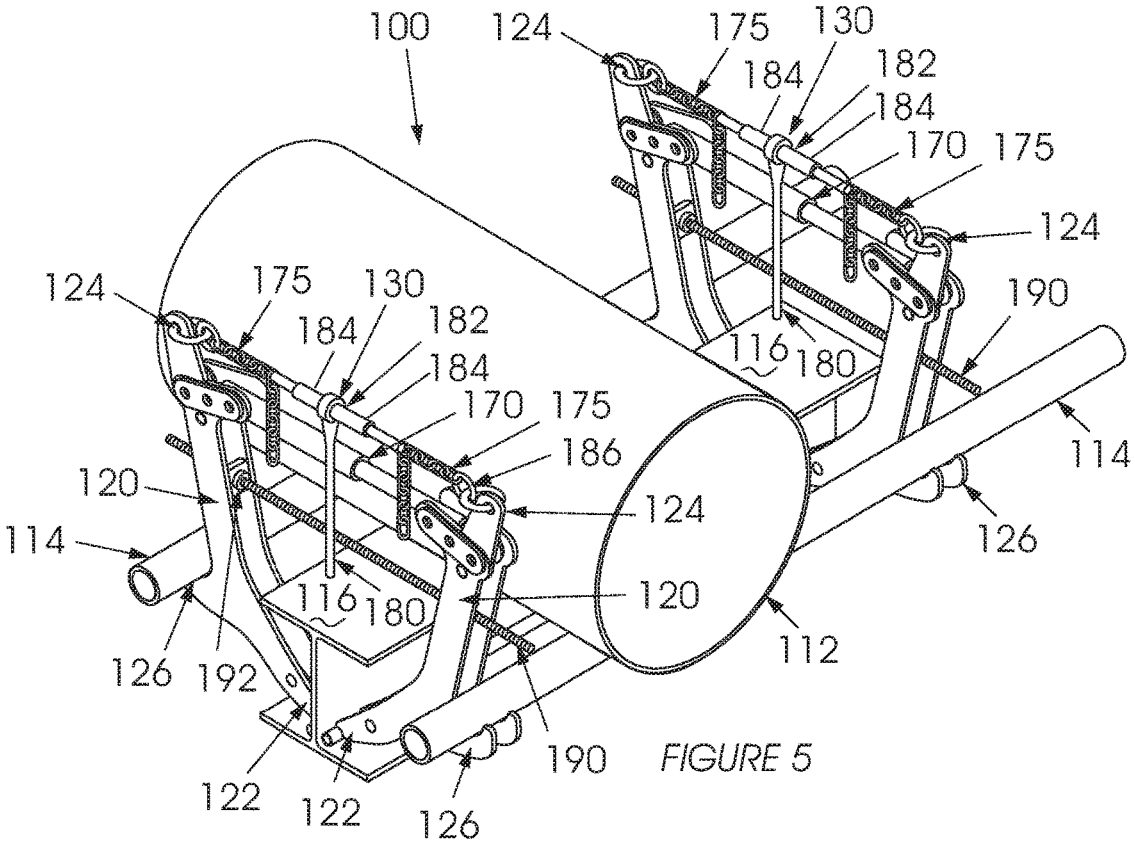
FIG. 5 shows an isometric view of a jack system according to a further embodiment of the invention, with the jack thereof being shown in its lowered configuration.

As shown in FIG. 5, the main movable body 130 comprises chain links 175 that extend linearly between the respective opposing second extremities 124; and a manually rotatable lever 180 connected via a ratchet mechanism 182 to said chain links 175. The lever is operable to permit an operator to manually either tauten or release tension between the chain links 175.

Rigid limbs 184 are shown in FIG. 5 to flank the ratchet mechanism 182, ends of each limb comprising a hook 186 to permit selective positioning of said hook 186 through any metal ring of said number of chain links 175 thereby to selectively raise or lower the elongate holding members 114 depending on which chain link 175 or metal ring the hook 186 extends through. Accordingly, in use, by turning the lever 180 in one direction or the other, the ratchet mechanism 182 is actuated to either tauten the chain links 175 or release tension thereon. In so doing, the hook 186 may be positioned to extend through any of a number of metal rings of the chain links 175 thereby to select the appropriate load on the jack system 100 and elevation of the seating means 126.

The jack system 100, accordingly includes use of the hydraulic cylinders 134 and movable pistons 136 as part of the movable body 170. This movable body 170 is typically used in addition to the movable body 130, comprising the manually actuated lever and ratchet mechanism 182.

Figure 2:
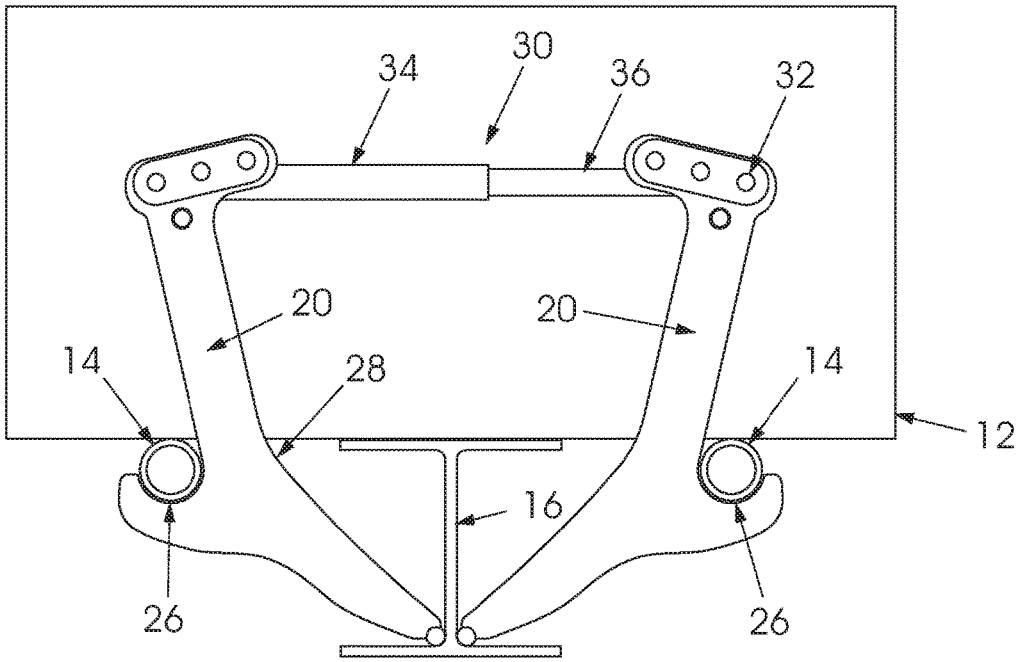
FIG. 2 shows an end view of the pipe jack system of FIG. 1.
Figure 4:
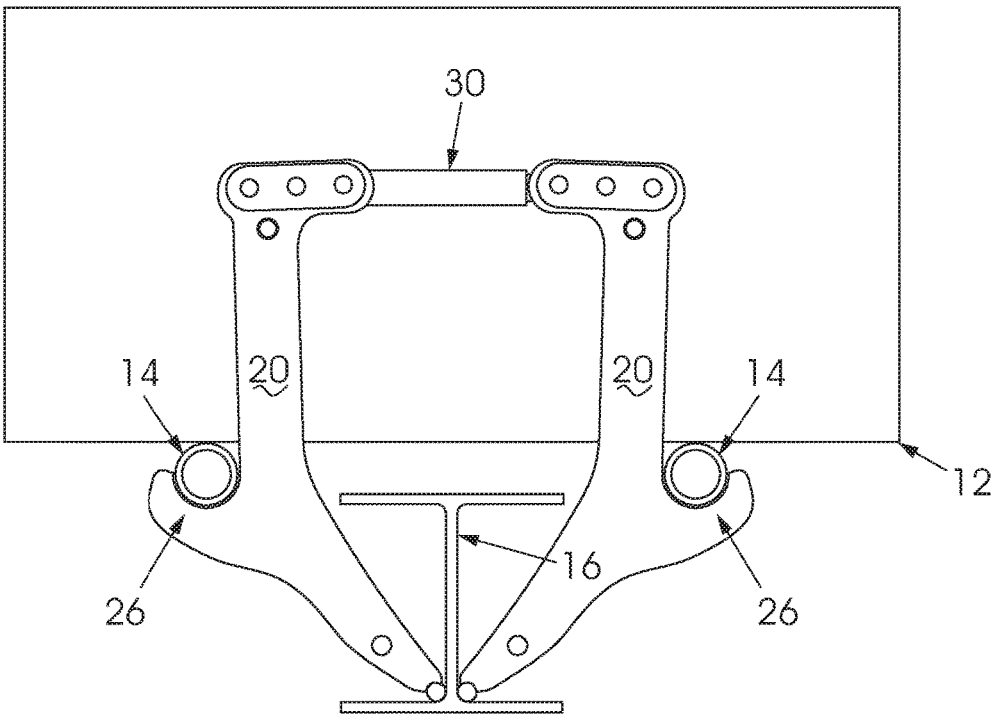
FIG. 4 shows an end view of the pipe jack system shown in FIG. 3.
Figure 6:
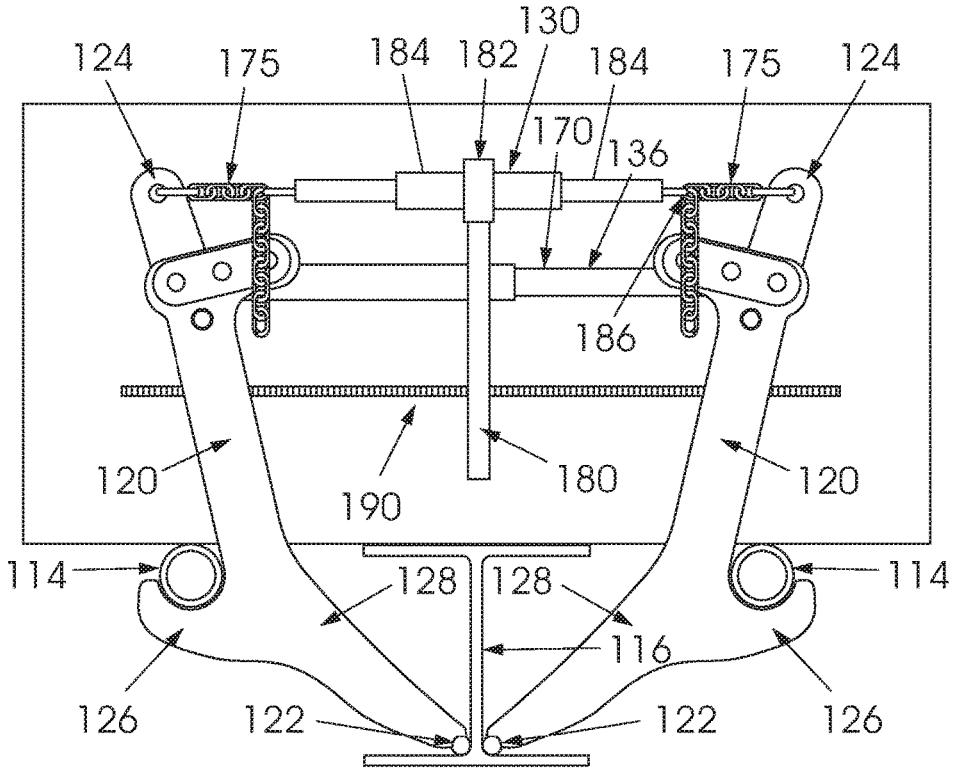
FIG. 6 shows an end view of the pipe jack system of FIG. 5.
Figure 7:
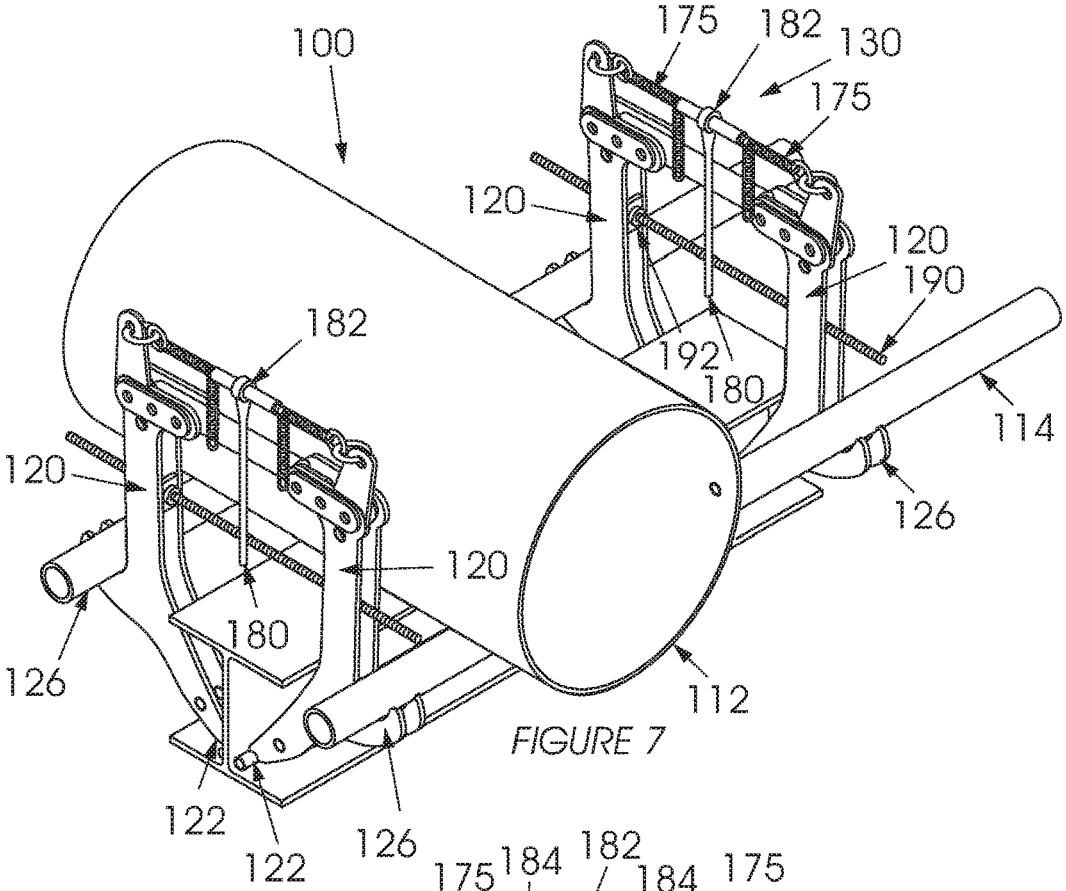
FIG. 7 shows an isometric view of the pipe jack system of FIG. 5, with the pipe jack thereof being shown in its raised configuration.
Figure 8:
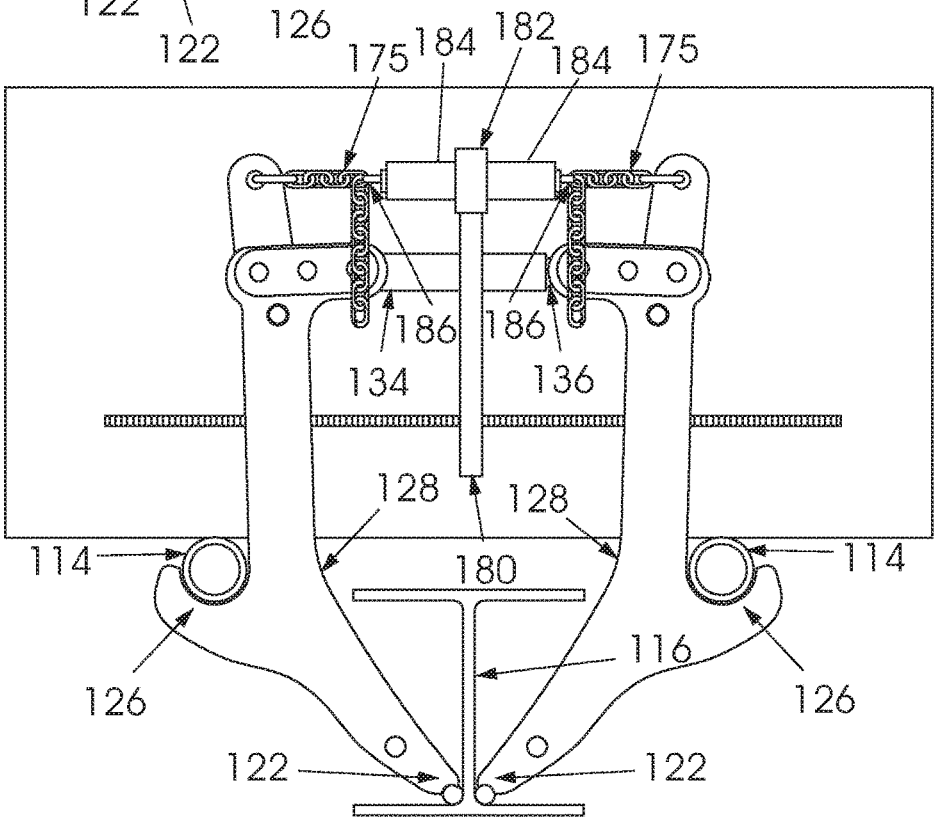
FIG. 8 shows an end view of the pipe jack system shown in FIG. 7.

As best shown in FIGS. 2 and 6, the first extremity 22,122 has a rounded surface, more preferably a rod-shaped protuberance, connected to extend transverse to a longitudinal axis of each arm 20,120. As can be seen in FIGS. 4 and 8, an obtuse angle is defined where a bend is formed in a central region of each arm 20 between upper and lower legs thereof, thereby to assist in efficient functioning of the raising and lowering of the pipe 12,112.

It will be appreciated that each arm 20 with its first 22,122 and second 24,124 extremities resemble the shape of a "boomerang", when viewed in plan view. As such, any angle of between about 100° and 130° may be formed between the first and second extremities as an elbow or bend 28,128 is formed at a central region of each arm 20,120 between these extremities.

It is further envisaged that a number of fail-safe mechanisms may be incorporated without departing from the spirit and scope of the invention. One such mechanism includes an elongate rod 190 extending linearly below the main movable body 130 and having a threaded outer surface to which lock-out nuts 192 are secured so that opposing ends of the lock out rod 190 can be locked out relative to the respective arms 120 upon reach of a desired elongate holding member elevation.

In use with live pipes, e.g. operating pipelines, the movable body 170 is first employed, with all operating personnel out of arms way, and with the necessary hydraulic pressure means (not shown) attached. Accordingly, use of the hydraulic system 170, acts as a safety precaution as the live pipes 112 on which work need to be conducted may comprise weak spots or leaks that could burst open upon initial lifting of the pipes 112 to release either dangerous pipe content or hazardous gasses likely to endanger the lives of people in the immediate vicinity of the pipes 112. Once initial lift is accomplished by means of movable body 170 and without any person in the immediate vicinity of the live pipes 112, the hydraulic pressure means will be disconnected and a safety officer can move closer to inspect the partially lifted pipes 112 and the area to be worked on, before declaring the work area in the immediate vicinity of the pipes 112, for example, gas leak free and safe, thereby allowing work to be conducted. The movable body 130 is then used to fine tune and reach the exact pre-determined suitable elevation of the seating means 126, before the lock out nuts 192 are secured to the lock out rod 190. In the event of empty or non-live pipes 112 needs to be inspected or worked on, the system 10 can be utilized, i.e. without the need of movable body 170 and its associated hydraulic system. After this, inspection, repair and/or paint work can safely be conducted. Subsequent to completion of the required work on the pipes, the safety lock-out rod 190 and nuts 192 are first removed followed by manual release of tension in the chain links 175 by reverse rotation of the rotatable lever 180. Unhooking of the chain links 175 then occurs main movable body so that the pipes 112 can be finally lowered to their original position in contact with the fixed support structure or I-beam 116.

It will be appreciated that pipelines may be supported in numerous ways with access to the "contact area" between pipe and support therefore being extremely difficult. It is also often an unsafe and expensive operation to access the "contact area" as pipelines often run at elevated levels.

The applicant believes that this controlled pipe jack system has been developed to minimise the safety hazards, reduce risk and improve on cost effectiveness. The pipe jack system is versatile and accommodates most restrictions. It also caters for simultaneous access to any number of contact areas. This reduces cost and time substantially during pipe maintenance operations. It will further be appreciated that the pipe jack system, will always be accompanied with a formal engineered design as to the number of jacks and the spacing thereof relative to the piping. Such engineered design will be capable of allowing for calculation of sufficient support to the support structure and pipelines and will consider, inter alia, site conditions, weight of lines, line stresses and movements, point loading/bending moments and accompanying safety factors.

The main safety feature includes for remote activation of the pipe jack system by hydraulic jacking and further lockout systems for safe access.

With this jack system, connection points of live lines, can now be inspected and repaired economically and safely.

The jack systems 10,100 and jacks 50,150 associated therewith are believed to provide a simple and effective alternative to existing devices used in the pipe lifting industry.

The monopoly for which patent protection is claimed is set out in the set of claims that follows hereinafter.

The invention claimed is:

1. A jack system for selectively raising or lowering one or more structures from a first position to a second position and back from said second position to said first position, comprising:

a fixed support structure;

at least two opposing and spaced apart jacks, each jack comprising a pair of arms longitudinally spaced apart from each other wherein each pair of arms has lower end portions and upper end portions, wherein said lower end portions are movably connected to said fixed support structure, and wherein said arms extend upwardly at predetermined angles with respect to said fixed support structure;

a pair of longitudinally extending support members fixedly mounted upon central portions of said pair of arms so as to support one or more structures disposed transversely with respect to said pair of longitudinally extending support members; and retractable and extensible mechanisms operatively connected to said upper end portions of each one of said pair of arms such that as said retractable and extensible mechanisms are retracted, said upper end portions of each one of said pair of arms are drawn together so as to cause each one of said pair of arms to pivotally move said lower end portions of said pair of arms relative to said fixed support structure and thereby elevate said pair of longitudinally extending support members so as to, in turn, elevate the one or more structures supported upon said pair of longitudinally extending support members, whereas when said retractable and extensible mechanisms are extended, said upper end portions of each one of said pair of arms are moved apart from each other so as to thereby cause each one of said pair of arms to pivotally move said lower end portions of said pair of arms relative to said fixed support structure and thereby lower said pair of longitudinally extending support members so as to, in turn, lower the one or more structures supported upon said longitudinally extending support members.

2. The jack system of claim 1, comprising:

three or more opposing and spaced apart jacks laterally facing each other, with said one or more structures to be selectively raised and lowered, spaced therebetween.

3. The jack system of claim 1, further comprising:

chains, wherein said chains comprise a plurality of chain links that extend linearly between said upper end portions of said pair of arms; and a manually rotatable lever connected via a ratchet mechanism to said chain links, said lever being operable to permit an operator to manually either tauten or release tension between said chain links.

4. The jack system of claim 3, further comprising:

rigid limbs that flank said ratchet mechanism, end portions of each one of said rigid limbs comprising a hook to permit selective positioning of said hook through any particular one of said plurality of chain links so as to thereby selectively raise or lower said pair of longitudinally extending support members depending upon which chain link of the plurality of chain links said hook extends through.

5. The jack system of claim 1, wherein:

each one of said retractable and extensible mechanisms comprises a hydraulically actuated piston displaceably located within a cylinder such that said piston is operably permitted to move rectilinearly within said cylinder upon electronic actuation thereof so as to thereby selectively displace said upper end portions of said pair of arms toward and away from each other.

6. The jack system of claim 1, further comprising:

a pair of elongate rods respectively extending linearly below said retractable and extensible mechanisms wherein each one of said pair of elongate rods has a threaded outer surface to which lock-out nuts are provided such that oppositely disposed ends of said elongate rods can be locked out when said arms reach a predetermined angle corresponding to predeterminedly desired elevation levels of said longitudinally extending support members.

7. The jack system of claim 1, wherein:

each one of said lower end portions of said arms comprises a protuberant formation configured to bear against and prop said lower end portions of said arms against an outer surface of said fixed support structure.

8. The jack system of claim 1, wherein:

said central portion of each one of said pair of arms comprises a semi-circular cut-out portion for receiving said pair of longitudinally extending support members.

9. The jack system of claim 8, wherein:

said central portions of said arms comprising said semi-circular cut-out portion are bent at an angle of between 100° and 130° so as to thereby permit upward movement of said longitudinally extending support members when said retractable and extensible mechanisms are actuated.

10. The jack system of claim 1, further comprising:

a concave appendage attached to, or formed within, each one of said central portions of each one of said pair of arms.

11. A method for selectively raising and lowering at least one structure to and from a predetermined position relative to a fixed support, comprising the steps of:

providing a fixed support structure;

providing at least two opposing and spaced apart jacks, wherein each jack comprises a pair of arms having upper end portions and lower end portions;

longitudinally spacing said pair of arms apart from each other and movably connecting lower end portions of pairs of arms to said fixed support structure, wherein said pair of arms extend upwardly at predetermined angles with respect to said fixed support structure;

fixedly mounting a pair of longitudinally extending support members upon central portions of said pair of arms so as to support at least one structure disposed transversely with respect to said pair of longitudinally extending support members; and operatively connecting retractable and extensible mechanisms to upper end portions of each one of said pair of arms such that as said retractable and extensible mechanisms are retracted, said upper end portions of each one of said pair of arms are drawn together so as to cause each one of said pair of arms to pivotally move around said lower end portions of said arms relative to said fixed support structure and thereby elevate said pair of longitudinally extending support members so as to, in turn, elevate the at least one structure supported upon said longitudinally extending support members, whereas when said retractable and extensible mechanisms are extended, said upper end portions of each one of said pair of arms are moved apart from each other so as to cause each one of said pair of arms to pivotally move said lower end portions of said pair of arms relative to said fixed support structure and thereby lower said pair of longitudinally extending support members so as to, in turn, lower the at least one structure supported upon said longitudinally extending support members.

* * * * *